US006838972B1

(12) United States Patent
Minervini et al.

(10) Patent No.: US 6,838,972 B1
(45) Date of Patent: Jan. 4, 2005

(54) PTC CIRCUIT PROTECTION DEVICES

(75) Inventors: Anthony D. Minervini, Orland Park, IL (US); Honorio S. Luciano, Elk Grove Village, IL (US)

(73) Assignee: Littelfuse, Inc., Des Plaines, IL (US)

( * ) Notice: Subject to any disclaimer, the term of this patent is extended or adjusted under 35 U.S.C. 154(b) by 0 days.

(21) Appl. No.: 09/510,116

(22) Filed: Feb. 22, 2000

Related U.S. Application Data

(60) Provisional application No. 60/121,043, filed on Feb. 22, 1999.

(51) Int. Cl.[7] ..... H01C 7/10

(52) U.S. Cl. ..... 338/22 R; 338/328; 338/332; 338/313; 338/22 SD

(58) Field of Search ..... 338/22 R, 22 SD, 338/328, 332, 314, 313

(56) References Cited

U.S. PATENT DOCUMENTS

| | | | | | |
|---|---|---|---|---|---|
| H415 | H | * | 1/1988 | Newnham et al. | 338/22 R |
| 4,786,888 | A | | 11/1988 | Yoneda et al. | 338/22 R |
| 4,992,771 | A | * | 2/1991 | Caporali et al. | 338/22 R |
| 5,493,266 | A | * | 2/1996 | Sasaki et al. | 338/22 R |
| 5,777,541 | A | * | 7/1998 | Vekeman | 338/22 R |
| 5,831,510 | A | * | 11/1998 | Zhang et al. | 338/22 R |
| 5,928,547 | A | | 7/1999 | Shea et al. | 219/505 |
| 6,020,808 | A | | 2/2000 | Hogge | 338/22 |
| 6,023,403 | A | * | 2/2000 | McGuire et al. | 338/22 R |
| 6,157,289 | A | * | 12/2000 | Kojima et al. | 338/22 R |
| 6,236,302 | B1 | * | 5/2001 | Barrett et al. | 338/22 R |

FOREIGN PATENT DOCUMENTS

| | | |
|---|---|---|
| JP | 7-248824 | 9/1995 |
| JP | 9-199302 | 7/1997 |
| JP | 9-266105 | 10/1997 |
| JP | 9-69416 A | 11/1997 |
| WO | WO 98/12715 | 3/1998 |
| WO | WO 98/29879 | 7/1998 |
| WO | WO 99/18585 | 4/1999 |
| WO | WO 99/53505 | 10/1999 |
| WO | WO 00/22631 | 4/2000 |
| WO | WO 00/24010 | 4/2000 |
| WO | WO 00/30127 | 5/2000 |
| WO | WO 00/38199 | 6/2000 |

OTHER PUBLICATIONS

JP 4–15001 patent abstract, Sunahara (Oct. 1990).*

* cited by examiner

*Primary Examiner*—Karl D. Easthom
(74) *Attorney, Agent, or Firm*—Bell, Boyd & Lloyd LLC

(57) ABSTRACT

An electrical circuit protection device with three supporting substrates, two PTC elements, and first and second end terminations. The first and third substrates have an electrode formed on a first surface thereof. The second substrate has electrodes formed on both surfaces thereof. The first PTC element is laminated between the first and second substrates, electrically connecting the first electrodes formed on the first and second substrates. The second PTC element is laminated between the second and third substrates, electrically connecting the second electrode formed on the second substrate and the first electrode formed on the third substrate. The end terminations wraps around opposite ends of the device. The first end termination is in electrical contact with the first electrodes formed on the second and third substrates and the second end termination is in electrical contact with the first electrode formed on the first substrate and the second electrode formed on the second substrate. The PTC elements are electrically connected in parallel between the end terminations. The multi-layered configuration allows for an increased electrical rating without increasing the overall footprint, i.e., length and width, of the device.

21 Claims, 3 Drawing Sheets

PTC CIRCUIT PROTECTION DEVICES

CROSS-REFERENCE TO RELATED APPLICATIONS

This application claims the benefit of U.S. Provisional Application No. 60/121,043 filed on Feb. 22, 1999.

TECHNICAL FIELD

The present invention relates generally to a surface mountable electrical circuit protection device and specifically to a multi-layer PTC configuration for higher rated devices.

BACKGROUND OF THE INVENTION

It is well known that the resistivity of many conductive materials change with temperature. Resistivity of a positive temperature coefficient ("PTC") material increases as the temperature of the material increases. Many crystalline polymers, made electrically conductive by dispersing conductive fillers therein, exhibit this PTC effect. These polymers generally include polyolefins such as polyethylene, polypropylene and ethylene/propylene copolymers. Certain doped ceramics such as barium titanate also exhibit PTC behavior.

At temperatures below a certain value, i.e., the critical or switching temperature, the PTC material exhibits a relatively low, constant resistivity. However, as the temperature of the PTC material increases beyond this point, the resistivity sharply increases with only a slight increase in temperature.

Electrical devices employing polymer and ceramic materials exhibiting PTC behavior have been used as overcurrent protection in electrical circuits. Under normal operating conditions in the electrical circuit, the resistance of the load and the PTC device is such that relatively little current flows through the PTC device. Thus, the temperature of the device due to $I^2R$ heating remains below the critical or switching temperature of the PTC device. The device is said to be in an equilibrium state (i.e., the rate at which heat is generated by $I^2R$ heating is equal to the rate at which the device is able to lose heat to its surroundings).

If the load is short circuited or the circuit experiences a power surge, the current flowing through the PTC device increases and the temperature of the PTC device (due to $I^2R$ heating) rises rapidly to its critical temperature. At this point, a great deal of power is dissipated in the PTC device and the PTC device becomes unstable (i.e., the rate at which the device generates heat is greater than the rate at which the device can lose heat to its surroundings). This power dissipation only occurs for a short period of time (i.e., a fraction of a second), however, because the increased power dissipation will raise the temperature of the PTC device to a value where the resistance of the PTC device has become so high that the current in the circuit is limited to a relatively low value. This new current value is enough to maintain the PTC device at a new, high temperature/high resistance equilibrium point, but will not damage the electrical circuit components. Thus, the PTC device acts as a form of a fuse, reducing the current flow through the short circuit load to a safe, relatively low value when the PTC device is heated to its critical temperature range. Upon interrupting the current in the circuit, or removing the condition responsible for the short circuit (or power surge), the PTC device will cool down below its critical temperature to its normal operating, low resistance state. The effect is a resettable, electrical circuit protection device.

SUMMARY OF THE INVENTION

The present invention provides an electrical circuit protection device having an increased electrical rating by increasing the active area of the PTC element while keeping the same footprint, i.e., length and width, of the device. Generally, to increase the electrical rating of a device, the area of the PTC element must be increased. Rather than expanding the overall dimensions of the device, the present invention employs multi-layers of PTC elements sandwiched between supporting substrates. First and second end terminations electrically connect the PTC elements in parallel to increase the active PTC area. The result is a device with the same footprint, but an increased electrical rating.

In a first embodiment there is provided a surface-mountable electrical circuit protection device comprising first, second and third substrates. The first substrate has a first electrode disposed on a first surface thereof. The second substrate has a first electrode disposed on a first surface thereof and a second electrode disposed on a second surface thereof. The third substrate has an electrode disposed on a first surface thereof. The first PTC element is sandwiched between the first and second substrates, electrically connecting the first electrodes of the first and second substrates. The second PTC element is sandwiched between the second and third substrates, electrically connecting the second electrode disposed on the second substrate and the first electrode formed on the third substrate. The first and second end terminations wrap around opposite ends of the device and electrically connect the PTC elements in parallel. The first end termination is in direct contact with the first electrodes disposed on the second and third substrates. The second end termination is in direct contact with the first electrode on the first substrate and the second electrode on the second substrate.

To further increase the overall rating of the device, in a second embodiment of the present invention, there is provided a device comprising three PTC elements sandwiched between four substrates. The first and fourth substrates have electrodes formed on only one surface (i.e., the inner surfaces of the substrate). The second and third substrates have electrodes formed on both the top and bottom surfaces. The first PTC element is sandwiched between the first substrate and the second substrate, electrically connecting the first electrodes of the first and second substrates. The second PTC element is sandwiched between the second and third substrates and electrically connects the second electrode on the second substrate with the first electrode on the third substrate. The third PTC element is sandwiched between the third and fourth substrates and electrically connects the second electrode on the third substrate and the first electrode on the fourth substrate. Similar to the first embodiment, the first and second end terminations wrap around opposite ends of the device and electrically connect the PTC elements in parallel. The first end termination directly contacts the first electrodes disposed on the second, third and fourth substrates. The second end termination directly contacts the first electrode on the first substrate and the second electrodes on the second and third substrates.

In a third embodiment, there is provided a method for manufacturing a multi-layered PTC electrical circuit protection device. First, the electrode configurations are formed on the first, second and third substrates. A first electrode is formed on a first surface of the first substrate. First and second electrodes are formed on first and second surfaces of the second substrate. A first electrode is formed on a first surface of the third substrate.

Next, the PTC elements are laminated between the substrates. The first PTC element is laminated between the first and second substrates, electrically connecting the first electrodes of the first and second substrates. The second PTC element is laminated between the second and third substrates, electrically connecting the second electrode on the second substrate and the first electrode on the third substrate. The result is a multi-layered PTC laminate.

A first wrap-around end termination is formed on one end of the laminate and directly contacts the first electrodes on the second and third substrates. A second wrap-around end termination is formed on the opposite end of the laminate and directly contacts the first electrode on the first substrate and the second electrode on the second substrate. Accordingly, the first and second end terminations electrically connect the PTC elements in parallel.

In a fourth embodiment, there is provided a method for manufacturing a plurality of electrical circuit protection devices. In a first step, electrode configurations are formed on the first, second and third substrates. A plurality of first electrodes are formed on a first surface of the first substrate. A plurality of first electrodes is formed on a first surface of the second substrate and a plurality of second electrodes is formed on a second surface of the second substrate. A plurality of first electrodes is formed on a first surface of the third substrate.

Next, thin layers of PTC material are laminated between the substrates. A first PTC layer is laminated between the plurality of first electrodes formed on the first substrate and the plurality of first electrodes formed on the second substrate. A second PTC layer is laminated between the plurality of second electrodes formed on the second substrate and the plurality of first electrodes formed on the third substrate to form a multi-layered PTC sheet. A plurality of openings are formed in the sheet to expose opposite end portions of the multi-layers (i.e., the substrates, the electrodes and the PTC layers). A first conductive layer is applied to the sheet and the exposed surfaces created by the openings. Portions of the first conductive layer are removed to create a plurality of first and second end terminations, each of the plurality of end terminations directly contacting one of the first electrodes formed on the second and third substrates, and each of the plurality of second end terminations directly contacting one of the first electrodes on the first substrate and one of the second electrodes formed on the second substrate. In a final step, the sheet is formed into a plurality of electrical circuit protection devices by cutting or dicing through the openings. Each device includes a first and a second end termination electrically connecting the PTC elements in parallel.

In a preferred embodiment and in order to buildup the end terminations to handle higher current capacities, a second conductive layer is applied to the laminate prior to removing portions of the layer. Further, in order to make the devices more susceptible to mounting on a PC board (i.e., soldering) after the end terminations are formed by creating non-conductive gaps in the first and second conductive layers, a third conductive layer (e.g., tin) is applied to the second conductive layer.

BRIEF DESCRIPTION OF THE DRAWINGS

A better understanding of the present invention will be had upon reference to the following detailed description and accompanying drawings. The size and thickness of the various elements illustrated in the drawings have been greatly exaggerated to more clearly show the electrical devices of the present invention.

DETAILED DESCRIPTION OF THE INVENTION

Figure 1:
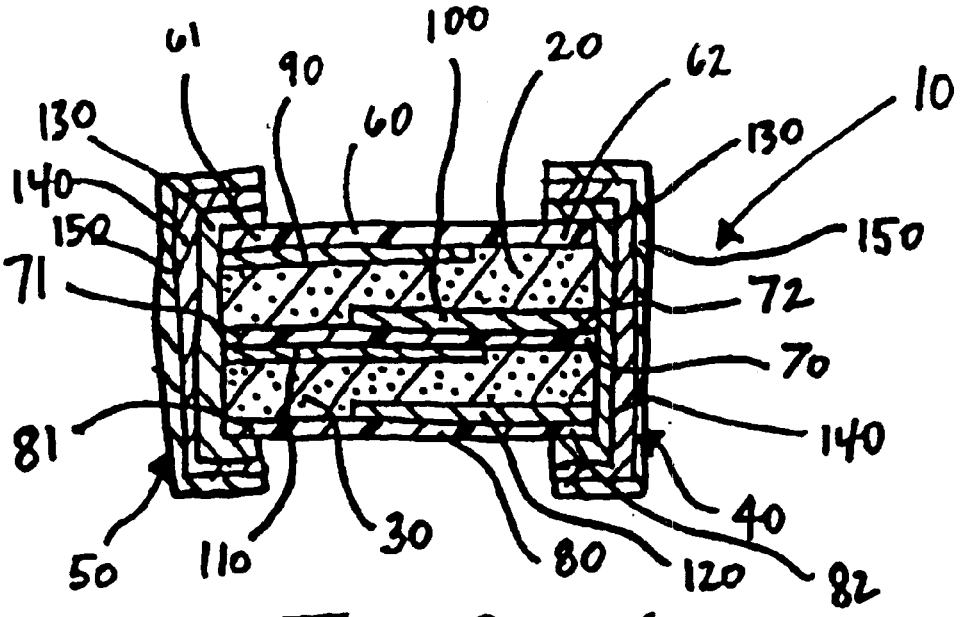
FIG. 1 is a front view of an electrical device according to a first embodiment of the present invention.

While this invention is susceptible of embodiment in many different forms, there is shown in the drawings and will herein be described in detail preferred embodiments of the invention with the understanding that the present disclosure is to be considered as an exemplification of the principles of the invention.

FIG. 1 illustrates a first embodiment of an electrical device 10 according to the present invention. The device 10 is comprised of first and second PTC elements 20,30 electrically connected in parallel between first and second end terminations 40,50. The first and second PTC elements 20,30 are interposed between first, second and third substrates 60,70,80.

Generally, the PTC elements 20,30 are composed of a PTC composition comprised of a polymer component and a conductive filler component. The polymer component may comprise a polyolefin having a crystallinity of at least 40%. Suitable polymers include polyethylene, polypropylene, polybutadiene, polyethylene acrylates, ethylene acrylic acid copolymers, and ethylene propylene copolymers. In a preferred embodiment, the polymer component comprises polyethylene and maleic anhydride, e.g., Fusabond™ brand manufactured and sold by DuPont. The conductive filler is dispersed throughout the polymer component in an amount sufficient to ensure that the composition exhibits PTC behavior. Alternatively, the conductive filler can be grafted to the polymer component.

Generally, the conductive filler component will be present in the PTC composition by approximately 25–75% by weight. Suitable conductive fillers to be used in the present invention include powders, flakes or spheres of the following metals: nickel, silver, gold, copper, silver-plated copper, or metal alloys. The conductive filler may also comprise carbon black, carbon flakes or spheres, or graphite. Particularly useful PTC compositions have a resistivity at 25° C. of less than 5 ohm cm, especially less than 3 ohm cm, and preferably less than 1 ohm cm, e.g., 0.5 to 0.1 ohm cm. Suitable PTC compositions for use in the present invention are disclosed in U.S. patent application Ser. No. 08/614,038 and U.S. Pat. Nos. 4,237,441, 4,304,987, 4,849,133, 4,880,577, 4,910,389 and 5,190,697, the disclosures of which are incorporated herein by reference.

The substrates 60,70,80 are preferable electrically insulating and provide support for the device 10. Suitable materials for use as the substrates in the present invention include: ceramic, FR-4 epoxy, glass and melamine. The first substrate 60 has a first electrode 90 formed on a first (bottom) surface thereof. The second substrate 70 has a first electrode 100 formed on one surface (top) and a second electrode 110 formed on another (bottom) surface. The third substrate 80 has a first electrode 120 formed on a first (top) surface thereof. In general, the electrodes can be formed of any conductive metal, e.g., silver, copper, zinc, nickel, gold and alloys thereof, and can be deposited on the substrates via any conventional deposition method, e.g., vapor deposition, sputtering, plating, etc.

In the preferred embodiment, the substrates 60,70,80 are comprised of a copper-clad, FR-4 epoxy. The electrode configurations are formed using a conventional masking and etching process, or the photo lithographic process disclosed in U.S. Pat. No. 5,699,607, the disclosure of which is incorporated fully herein by reference. As illustrated in FIG. 1, the first electrode 90 formed on the first substrate 60 extends to one end 61 of the substrate 60 but not the other end 62. The electrodes 100,110 formed on the second substrate 70 extend to opposite ends of the substrate, i.e., the first electrode 100 extends to end 72 but not end 71, while the second electrode 110 extends to end 71 but not end 72. The electrode 120 formed on the third substrate 80 also extends to one end 82 but not the other end 81 of the substrate 80. This offset configuration of the electrodes is important to make the proper electrical connections with the first and second end terminations 40,50.

Figure 3:
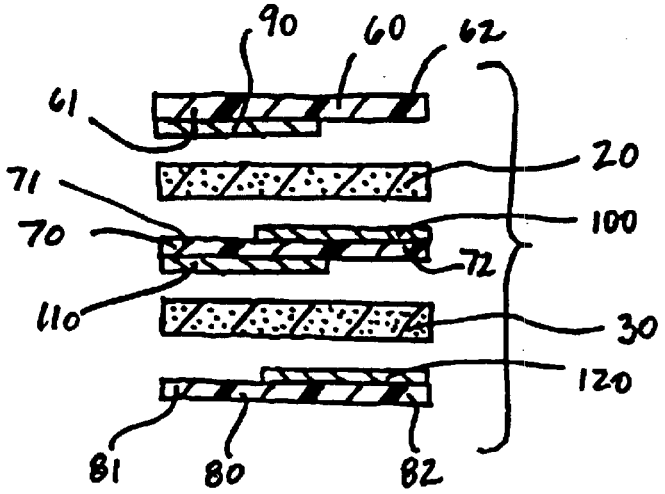
FIG. 3 is a partial exploded view of the components to be laminated in a method of manufacturing the device illustrated in FIG. 1.

Once the electrode configurations have been formed on the substrates and the PTC elements have been provided (preferably by extruding PTC material into thin sheets), the elements are aligned in a fixture (See, FIG. 3) and subjected to heat and pressure in a heated press to form a multi-layered laminate. The first PTC element 20 is sandwiched between the first and second substrates 60,70 and makes direct and electrical contact with electrodes 90,100. Due to the heat and pressure, the PTC element 20 fills the void or uneven surface created by the electrodes 90,100 covering only a portion of the surfaces of the substrates 60,70, respectively. Similarly, the second PTC element 30 is sandwiched between the second and third substrates 70,80 and makes direct and electrical contact with electrodes 110,120. Due to the heat and pressure, the PTC element 30 fills the void or uneven surface created by the electrodes 110,120 covering only a portion of the surfaces of the substrates 70,80, respectively. Excellent laminations have been formed using pressures in the range of 375–425 p.s.i and temperatures in the range of 200–250° C. when using copper-cad FR-4 epoxy substrates and electrodes.

Figure 4:
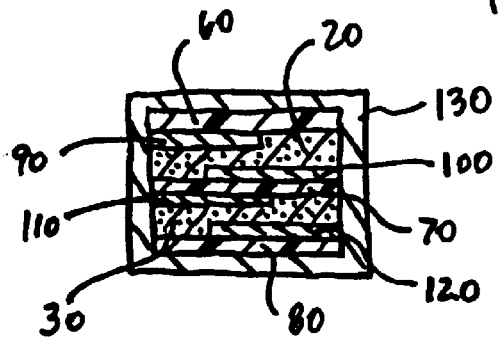
FIG. 4 illustrates the laminate of FIG. 3 having a first conductive layer applied thereto.
Figure 5:
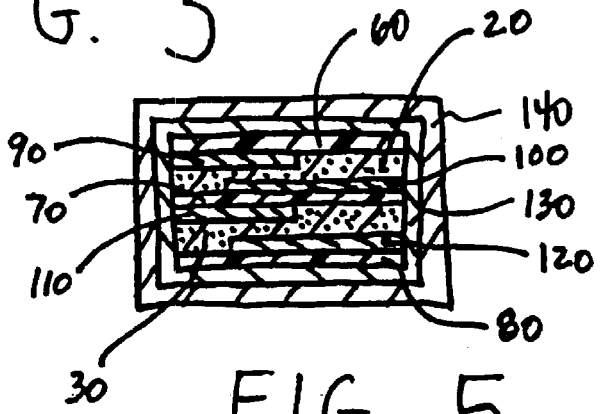
FIG. 5 illustrates the laminate of FIG. 3 having first and second conductive layers applied thereto.
Figure 6:
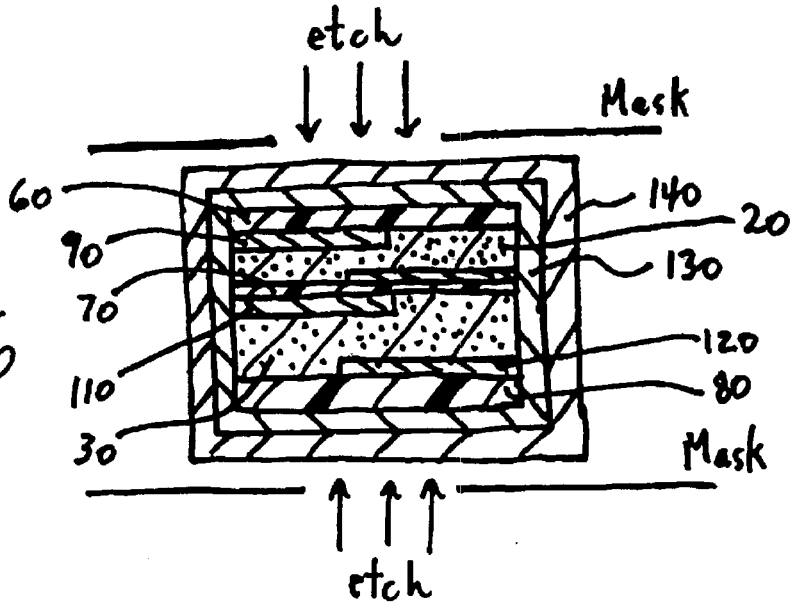
FIG. 6 illustrates the process of creating the first and second end terminations by etching away portions of the first and second conductive layers.

With reference to FIGS. 4–6, the first and second end terminations 40,50 are formed by depositing a first conductive layer 130 to the multi-layered laminate. A second conductive layer 140 is applied to the first conductive layer 130. The first and second conductive layers 130,140 are preferably a metal selected from the group including: copper, nickel, silver, gold, tin and zinc. The layers 130,140 can be deposited using any conventional metal deposition methods described above. In an especially preferred embodiment the first conductive layer 130 comprises copper and is deposited by electroless plating and the second conductive layer 140 comprises copper and is deposited by electrolytic plating. Portions of the first and second end conductive layers 130,140 are etched away to create non-conductive gaps in the layers and form end terminations 40,50. In a final step, a third conductive layer 150, preferably tin, is applied to the second conductive layer 140 to complete the formation of the first and second end terminations 40,50. The tin layer 150 can be applied directly to the electrolytic layer of copper 140 and not the exposed portions of the first and third substrates 60,80 by electrolytic plating.

Due to the offset configuration of the electrodes 90,100, 110,120, the first end termination 40 is in direct contact with electrodes 100,120 but does not make direct contact with electrodes 90,110. On the other hand, the second end termination 50 is in direct contact with electrodes 90,110 but not electrodes 100,120. As a result, the PTC elements 20,30 are electrically connected in parallel between the end terminations thus providing an increased active PTC area and a higher rated electrical device.

Figure 2:
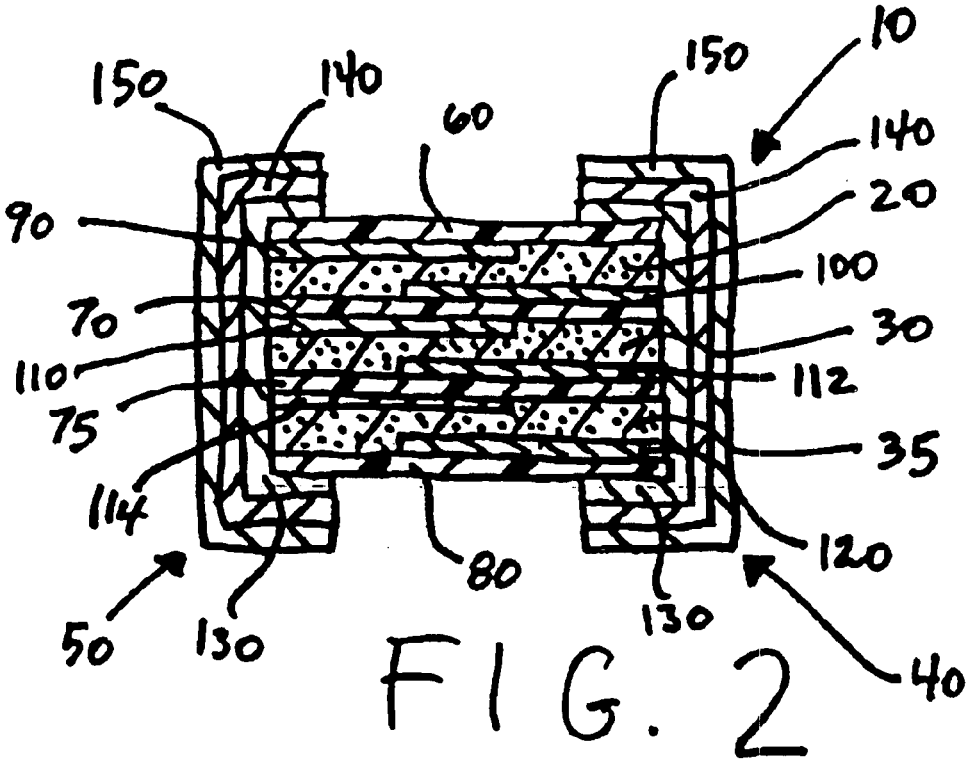
FIG. 2 is a front view of an electrical device according to a second embodiment of the present invention.

Referring now to FIG. 2, in a second embodiment the device 10 is comprised of three PTC elements 20,30,35 laminated between four substrates 60,70,75,80. The additional substrate, illustrated in FIG. 2 by reference numeral 75, has a similar offset electrode configuration as substrate 70, i.e., a first electrode 112 is formed on a first (top) surface and extends to one end but not the other end of the substrate 75, and a second electrode 114 is formed on a second surface (bottom) and extends to the opposite end of the substrate 75 as does the first electrode 112. In the embodiment illustrated in FIG. 2, the first end termination 40 is in direct contact with electrodes 100,112,120 but not electrodes 90,110,114, while the second end termination 50 is in direct contact with electrodes 90,110,114 but not electrodes 100,112,120. Accordingly, the PTC elements 20,30,35 are electrically connected in parallel between the wrap-around end terminations 40,50 and provide the device 10 with a higher electrical rating than could be provided in a device with the same length and width.

Figure 7:
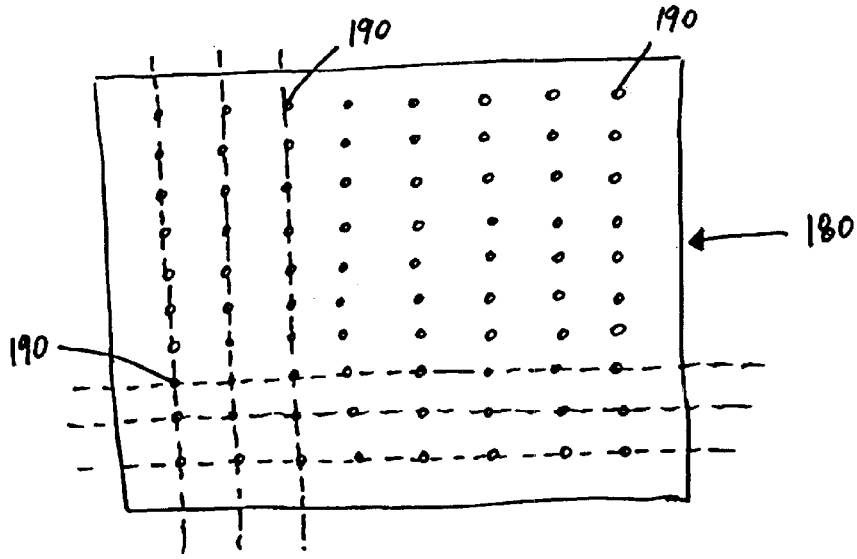
FIG. 7 illustrates a multi-layered PTC sheet utilized in manufacturing a plurality of devices according to one embodiment of the present invention.
Figure 8:
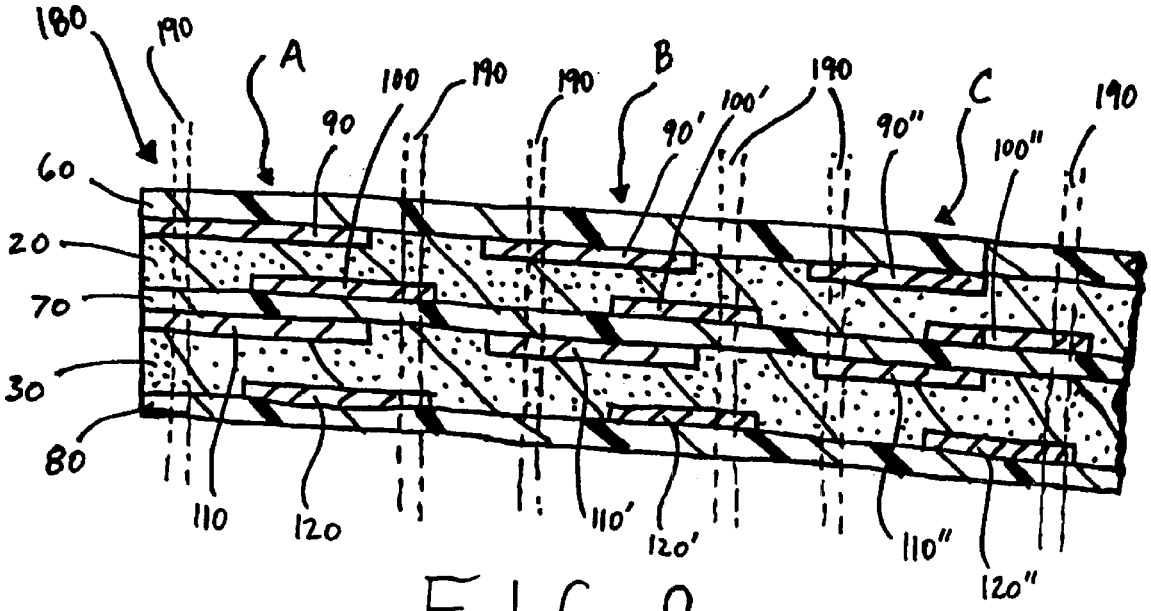
FIG. 8 illustrates a partial front view of the multi-layered PTC sheet illustrated in FIG. 7.

Referring now to FIGS. 7–8, a plurality of electrical devices 10 according to the present invention can be easily manufactured from a single multi-layered PTC sheet 180. For exemplary purposes the multi-layered PTC sheet 180 and the method for manufacturing a plurality of devices will be described with reference to the embodiment illustrated in FIG. 1. It should be understood, however, that the process described below can be carried out on devices having additional PTC layers.

The multi-layered PTC sheet 180 for example can have dimensions of 4 inches by 8 inches and is comprised of two PTC layers 20,30 interposed between three insulating substrates 60,70,80.

A plurality of first electrodes 90,90',90",etc. are formed on the first substrate 60. A plurality of first 100,100',100",etc. and second electrodes 110, 110',110",etc. is formed on the second substrate 70. A plurality of first electrodes 120,120', 120" is formed on the third substrate 80.

The first PTC element 20 (preferably in the form of a thin layer) is interposed between the first and second 60,70 substrates. The second PTC element 30 (also preferably in the form of a thin layer) is interposed between the second and third substrates 70,80. The following components are aligned in a fixture and placed in a heated press: the third substrate 80, the second PTC element 30, the second substrate 70, the first PTC element 20, and the first substrate 60. The components are laminated to form the multi-layered PTC sheet 180.

A plurality of openings 190 are formed in the sheet 180. The openings 190 may be circular in shape (as illustrated) or may be in the form of long slots, as long as the multi-layers are exposed. A first conductive layer 130 is then applied to the sheet 180. In a preferred embodiment the layer 130 comprises copper and is deposited via a conventional electroless plating method. The electroless copper is plated on the outer surfaces of the first and third substrates 60,80, as well as the exposed surfaces creating by he openings 190 in the sheet 180.

A second conductive layer 140 is then applied to the first conductive layer 130. The second conductive layer 140, preferably copper, is deposited via a conventional electrolytic plating method. The second conductive layer 140 may be necessary to build up the thickness of the conductive layers forming the end terminations 40,50 to handle increased current capacities.

Utilizing conventional masking/etching or photo lithographic processes mentioned above, portions of the first and second end conductive layers 130,140 are etched away to create non-conductive gaps in the layers and form end terminations 40,50. A third conductive layer 150, preferably tin, is applied to the second conductive layer 140 to complete the formation of the first and second end terminations 40,50. The tin layer 150 can be applied directly to the electrolytic layer of copper 140 and not the exposed portions of the first and third substrates 60,80 via electrolytic plating. In the final step, the sheets 180 are cut or diced through the plated openings 190 (along the dashed lines illustrated in FIG. 7), to form a plurality of electrical devices 10 as shown in FIG. 1.

What is claimed is:

1. A surface-mountable electrical circuit protection device comprising:

a first electrically insulative substrate having only one electrode disposed thereon;

a first PTC element comprised of a polymer with conductive particle dispersed therein and having a first end and a second end and a first surface and a second surface running therebetween;

a second electrically insulative substrate having a first end and a second end a first electrode disposed on a first surface thereof and a second electrode disposed on a second surface thereof, the first electrode disposed on the first surface of the second substrate extends to the second end of the second substrate but not the first end of the second substrate, the second electrode dispose don the second surface of the second substrate extends to the first end of the second substrate but not the second end of the second substrate;

a second PTC element comprised of a polymer with conductive particles dispersed therein and having a first end a second end and a first surface and a second surface running therebetween;

a third electrically insulative substrate having only one electrode disposed thereon;

the first PTC element positioned between the first and second supporting substrates such that: (i) the electrode disposed on the first substrate is also disposed on the first surface of the first PTC element and extends to the first end of the first PTC element but not the second end of the first PTC element; and (ii) the first electrode disposed on the second substrate is also disposed on the second surface of the first PTC element and extends to the second end of the first PTC element but not the first end of the first PTC element;

the second PTC element positioned between the second and third supporting substrates such that: (i) the second electrode disposed on the second substrate is also disposed on the first surface of the second PTC element and extends to the first end of the second PTC element but not the second end of the second PTC element; and (ii) the electrode disposed on the third substrate is also disposed on the second surface of the second PTC element and extends to the second end of the second PTC element but not the first end of the second PTC element;

a first conductive end termination wrapping around a first end of the device; and a second conductive end termination wrapping around a second end of the device.

2. The electrical device of claim 1 wherein the first, second and third substrates are formed from a material selected from the group consisting of ceramic, FR-4 epoxy, glass, and melamine.

3. The electrical device of claim 1 wherein, the first and second PTC elements are electrically connected in parallel.

4. The electrical device of claim 1 wherein, the first and second end terminations are comprised of a first and a second conductive layer.

5. The electrical device of claim 4 wherein, the first conductive layer of the first and second end terminations is comprised of copper.

6. The electrical device of claim 4 wherein, the second conductive layer of the first and second end terminations is comprised of tin.

7. The electrical device of claim 1 wherein, the first conductive end termination is in direct contact with first electrode disposed on the third substrate and the first electrode disposed on the second substrate.

8. The electrical device of claim 7 wherein, the second conductive end termination is in direct contact with the second electrode disposed on the second substrate and first electrode disposed on the first substrate.

9. The electrical device of claim 8 wherein, when current flows through the device the current flows from the first conductive end termination to the first electrode disposed on the third substrate and the first electrode disposed on the second substrate, through the first and second PTC elements to the second electrode disposed on the second substrate and the first electrode disposed on the first substrate, to the second conductive end termination.

10. A surface-mountable electrical circuit protection device comprising:

a first electrically insulating substrate having an electrode disposed on a first surface thereof;

a second electrically insulating substrate having a first end and a second end and a first electrode disposed on a first surface thereof and a second electrode disposed on a second surface thereof, the first electrode disposed on the first surface of the second substrate extends to one of the first or second end of the second substrate but not the other of the first or second end of the second substrate and the second electrode disposed on the second surface of the second substrate extends to one of the first or second end of the of the second substrate but not the other of the first of or second end of the second substrate;

a third electrically insulating substrate having a first electrode disposed on a first surface thereof and a second electrode disposed on a second surface thereof;

a fourth electrically insulating substrate having a first electrode disposed on a first surface thereof;

a first laminar PTC element comprised of a polymer having conductive particles dispersed therein, the first PTC element interposed between the first and second insulating substrates and electrically connecting the first electrode disposed on the first insulating substrate with the first electrode disposed on the second insulating substrate;

a second laminar PTC element comprised of a polymer having conductive particles dispersed therein, the second PTC element interposed between the second and third insulating substrates and electrically connecting the second electrode disposed on the second insulating substrate with the first electrode disposed on the third insulating substrate;

a third laminar PTC element comprised of a polymer having conductive particles dispersed therein, the third PTC element interposed between the third and fourth insulating substrates and electrically connecting the second electrode disposed on the third insulating substrate with the first electrode disposed on the fourth insulating substrate;

a first electrically conductive end termination wrapping around a first end of the device and electrically contacting the first electrode disposed on the fourth insulating substrate, the first electrode disposed on the third insulating substrate, and the first electrode disposed on the second substrate; and a second electrically conductive end termination wrapping around a second end of the device and electrically contacting the second electrode disposed on the third insulating substrate, the second electrode disposed on the second insulating substrate, and the first electrode disposed on the first insulating substrate.

11. The circuit protection device of claim 10 wherein, the first end termination is disposed on the first and fourth insulating substrates adjacent one end of the device.

12. The circuit protection device of claim 10 wherein, the second end termination is disposed on the first and fourth insulating substrates adjacent a second end of the device.

13. The circuit protection device of claim 10 wherein, the first electrically insulating substrate has a first end and a second end, the first electrode disposed on the first surface of the first electrically insulating substrate extends to the second end but not the first end of the first electrically insulating substrate.

14. The circuit protection device of claim 10 wherein, the second electrically insulating substrate has a first end and a second end, the first electrode disposed on the first surface of the second electrically insulating substrate extends to the first end but not the second end of the second electrically insulating substrate and the second electrode disposed on the second surface of the second electrically insulating substrate extends to the second end but not the first end of the second eclectically insulating substrate.

15. The circuit protection device of claim 10 wherein, the third electrically insulating substrate has a first end and a second end, the first electrode disposed on the first surface of the third electrically insulating substrate extends to the first end but not the second end of the third electrically insulating substrate and the second electrode disposed on the second surface of the third electrically insulating substrate extends to the second end but not the first end of the third electrically insulating substrate.

16. The circuit protection device of claim 10 wherein, the fourth electrically insulating substrate has a first end and a second end, the first electrode disposed on the first surface of the fourth electrically insulating substrate extends to the first end but not the second end of the fourth electrically insulating substrate.

17. A surface-mountable electrical circuit protection device comprising:

A first electrically insulating substrate having an electrode disposed on a first surface thereof;

A second electrically insulating substrate having a first end and a second end a first electrode disposed on a first surface thereof and a second electrode disposed on a second surface thereof, the first electrode disposed on the first surface of the second electrically insulating substrate extends to the first end but not the second end of the second electrically insulating substrate and the second electrode disposed on the second surface of the second electrically insulating substrate extends to the second end but not the first end of the second electrically insulating substrate;

A third electrically insulating substrate having a first electrode disposed on a first surface thereof and a second electrode disposed on a second surface thereof;

A fourth electrically insulating substrate having a first electrode disposed on a first surface thereof;

A first laminar PTC element comprised of a polymer having conductive particles dispersed therein, the first PTC element interposed between the first and second electrically insulating substrates and electrically connecting the first electrode disposed on the first electrically insulating substrate and with the first electrode disposed on the second electrically insulating substrate;

a second laminar PTC element comprised of a polymer having conductive particles dispersed therein, the second PTC element interposed between the second and third electrically insulating substrates and electrically connecting the second electrode disposed on the second electrically insulating substrate with the first electrode disposed on the third electrically insulating substrate;

a third laminar PTC element comprised of a polymer having conductive particles dispersed therein, the third PTC element interposed between the third and fourth electrically insulating substrates and electrically connecting the second electrode disposed on the third insulating substrate with the first electrode disposed on the fourth electrically insulating substrate;

a first electrically conductive and termination wrapping around a first end of thee device and electrically contacting the first electrode disposed on the fourth electrically insulating substrate, the first electrode disposed on the third electrically insulating substrate, and the first electrode disposed on the second electrically insulating substrate; and a second electrically conductive end termination wrapping around a second end of the device and electrically contacting the second electrode disposed on the third electrically insulating substrate, the second electrode disposed on the second electrically insulating substrate, and the first electrode disposed on the first electrically insulating substrate.

18. The circuit protection device of claim 17 wherein the third electrically insulating substrate has a first end and a second end, the first electrode disposed on the first surface of the third electrically insulating substrate extends to the first end but not the second end of the third electrically insulating substrate and the second electrode disposed on the second surface of the third electrically insulating substrate extends to the second end but not the first end of the third electrically insulating substrate.

19. A surface-mountable electrically circuit protection device comprising:

a first electrically insulating substrate having an electrode disposed on a first surface thereof;

a second electrically insulating substrate having a first electrode disposed on a first surface thereof and a second electrode disposed on a second surface thereof;

a third electrically insulating substrate having a first end and a second end and a first electrode disposed on a first surface there of and a second electrode disposed on a second surface thereof, the first electrode disposed on the first surface of the third electrically insulating substrate extends to the first end but not the second end of the third electrically insulating substrate and t second electrode disposed on the second surface of the third electrically insulating substrate extends to the second end but not the first end of the third electrically insulating substrate;

a fourth electrically insulating substrate having a first electrode disposed on a first surface thereof;

a first laminar PTC element comprised of a polymer having conductive particles dispersed therein, the first PTC element interposed between the first and second electrically insulating substrates and electrically connecting the first electrode disposed on the first electrically insulating substrate with the first electrode disposed on the second electrically insulating substrate;

a second laminar PTC element comprised of a polymer having conductive particles dispersed therein, the second PTC element interposed between the second and third electrically insulating substrates and electrically connecting the second disposed on the second electrically insulating substrate with the first electrode disposed on the third electrically insulating substrate;

a third laminar PTC element comprised of a polymer having conductive particles dispersed therein, the third PTC element interposed between the third and fourth electrically insulating substrates and electrically connecting the second electrode disposed on the third electrically insulating substrate with the first electrode disposed on the fourth electrically insulating substrate;

a first electrically conductive end termination wrapping around a first end f the device and electrically contacting the first electrode disposed on the fourth electrically insulating substrate, the first electrode disposed on the third electrically insulating substrate, and the first electrode disposed on the second electrically substrate; and a second electrically conductive end termination wrapping around a second end of the device and electrically contacting the second electrode disposed on the third electrically insulating substrate, the second electrode disposed on the second electrically insulating substrate, and the first electrode disposed on the first electrically insulating substrate.

20. The circuit protection device of claim 10 wherein the second electrically insulating substrate has a first end and a second end, the first electrode disposed on the first surface of the second electrically insulating substrate extends to the first end but not the second end of the second electrically insulating substrate and the second electrode disposed on the second surface of the second electrically insulating substrate extends to the second end but not the first end of the second electrically insulating substrate.

21. A surface-mountable electrical circuit protection device comprising:

a first electrically insulating substrate having an electrode disposed on a first surface thereof;

a second electrically insulating substrate having a first end a second end and a first electrode disposed on a first surface thereof and a second electrode disposed on a second surface thereof, the first electrode disposed on the first surface of the second electrically insulating substrate extends to the first end but not the second end of the second electrically insulating substrate and the second electrode disposed on the second surface of the second electrically insulating substrate extends to the second end but not the first end of the second electrically insulating substrate;

a third electrically insulating substrate having a first end and a second end and a first electrode disposed on a first surface thereof and a second electrode disposed on a second surface thereof, the first electrode disposed on the first surface of the third electrically insulating substrate extends to the first end but not the second end of the third electrically insulating substrate and the second electrode disposed on the second surface of the third electrically insulating substrate extends to the second end but not the first end of the third electrically insulating substrate;

a fourth electrically insulating substrate having a first electrode disposed on a first surface thereof;

a first laminar PTC element comprised of a polymer having conductive particles dispersed therein, the first PTC element interposed between the first and second electrically insulating substrates and electrically connecting the first electrode disposed on the first electrically insulating substrate with the first electrode disposed on the second electrically insulating substrate;

a second laminar PTC element comprised of a polymer having conductive particles dispersed therein, the second PTC element interposed between the second and third electrically insulating substrates and electrically connecting the second electrode disposed on the second electrically insulating substrate with the first electrode disposed on the third electrically insulating substrate;

a third laminar PTC element comprised of a polymer having conductive particles dispersed therein, the third PTC element interposed between the third and fourth electrically insulating substrates and electrically connecting the second electrode disposed on the third electrically insulating substrate with the first electrode disposed on the fourth electrically insulating substrate;

a first electrically conductive end termination wrapping around a first end of the device and electrically contacting the first electrode disposed on the fourth electrically insulating substrate, the first electrode disposed on the third electrically insulating substrate, and the first electrode disposed on the second electrically insulating substrate; and a second electrically conductive end termination wrapping around a second end of the device and electrically contacting the second electrode disposed on the third electrically insulating substrate, the second electrode disposed on the second electrically insulating substrate, and the first electrode disposed on the first electrically insulating substrate.

* * * * *